US009151251B2

(12) United States Patent
Matsunaga et al.

(10) Patent No.: US 9,151,251 B2
(45) Date of Patent: Oct. 6, 2015

(54) EVAPORATIVE EMISSION CONTROL DEVICE FOR AN INTERNAL COMBUSTION ENGINE

(75) Inventors: Hideo Matsunaga, Okazaki (JP); Hitoshi Kamura, Okazaki (JP); Noriaki Kinoshita, Toyota (JP); Hisakazu Ikedaya, Okazaki (JP)

(73) Assignee: MITSUBISHI JIDOSHA KOGYO KABUSHIKI KAISHA, Tokyo (JP)

( * ) Notice: Subject to any disclaimer, the term of this patent is extended or adjusted under 35 U.S.C. 154(b) by 585 days.

(21) Appl. No.: 13/543,388

(22) Filed: Jul. 6, 2012

(65) Prior Publication Data

US 2013/0008414 A1 Jan. 10, 2013

(30) Foreign Application Priority Data

Jul. 7, 2011 (JP) ..... 2011-151166

(51) Int. Cl.
*F02M 33/02* (2006.01)
*F02M 25/08* (2006.01)

(52) U.S. Cl.
CPC ..... *F02M 25/0836* (2013.01); *F02M 25/0809* (2013.01)

(58) Field of Classification Search
CPC ... F02M 25/0836; F02M 25/08; F02M 37/00; F02D 41/02; F02D 41/22; F02D 45/00; F16K 17/196; F16K 31/06; B60K 15/077
USPC ..... 123/516–521, 531, 533, 378, 406.65, 123/406.69, 434, 461, 698–700, 677; 73/114.38–114.45; 701/32.7, 102–105
See application file for complete search history.

(56) References Cited

U.S. PATENT DOCUMENTS

| | | | | |
|---|---|---|---|---|
| 6,575,146 | B1 * | 6/2003 | Kanai et al. | 123/520 |
| 6,722,187 | B2 * | 4/2004 | Grieve et al. | 73/49.7 |
| 6,807,847 | B2 * | 10/2004 | Steckler et al. | 73/49.7 |
| 6,837,224 | B2 * | 1/2005 | Kidokoro et al. | 123/520 |
| 6,840,292 | B2 * | 1/2005 | Hart et al. | 141/59 |
| 6,951,126 | B2 * | 10/2005 | Perry et al. | 73/49.7 |
| 6,988,396 | B2 * | 1/2006 | Matsubara et al. | 73/114.39 |
| 7,028,534 | B2 * | 4/2006 | Watanabe et al. | 73/49.7 |
| 7,036,359 | B2 * | 5/2006 | Hayakawa et al. | 73/114.39 |
| 7,043,972 | B2 * | 5/2006 | Matsubara et al. | 73/114.39 |
| 7,066,152 | B2 * | 6/2006 | Stroia et al. | 123/467 |
| 7,086,276 | B2 * | 8/2006 | Cook et al. | 73/40.5 R |
| 7,121,137 | B2 * | 10/2006 | Hosoya | 73/114.39 |
| 7,350,512 | B1 * | 4/2008 | Meacham et al. | 123/520 |
| 7,367,326 | B2 * | 5/2008 | Shikama et al. | 123/520 |
| 7,762,126 | B2 * | 7/2010 | Shibuya | 73/114.39 |
| 7,878,046 | B2 * | 2/2011 | Bolt et al. | 73/49.7 |

(Continued)

FOREIGN PATENT DOCUMENTS

| | | |
|---|---|---|
| JP | 5-180096 A | 7/1993 |
| JP | 4107053 B2 | 6/2004 |
| JP | 2010-71198 A | 4/2010 |

*Primary Examiner* — Stephen K Cronin
*Assistant Examiner* — Joseph Dallo
(74) *Attorney, Agent, or Firm* — Birch, Stewart, Kolasch & Birch, LLP

(57) ABSTRACT

A leakage judgment with respect to a fuel tank is carried out. If the fuel tank is not leaking, a leakage judgment with respect to a canister is carried out. If there is a possibility of leakage in the fuel tank, a leakage judgment with respect to the fuel tank and the canister is carried out. If it is judged that there is leakage in the fuel tank and the canister, the leakage judgment with respect to the canister is carried out.

2 Claims, 7 Drawing Sheets

(56) References Cited

U.S. PATENT DOCUMENTS

| | | | | |
|---|---|---|---|---|
| 2001/0008136 | A1* | 7/2001 | Kitamura et al. | 123/516 |
| 2001/0042399 | A1* | 11/2001 | Dawson et al. | 73/49.7 |
| 2002/0104516 | A1* | 8/2002 | Kaiser et al. | 123/520 |
| 2003/0000290 | A1* | 1/2003 | Weldon et al. | 73/49.7 |
| 2004/0089275 | A1* | 5/2004 | Kidokoro et al. | 123/520 |
| 2004/0112341 | A1* | 6/2004 | Mashimo et al. | 123/520 |
| 2004/0123845 | A1* | 7/2004 | Nishioka et al. | 123/520 |
| 2004/0250805 | A1* | 12/2004 | Osanai | 123/698 |
| 2004/0261765 | A1* | 12/2004 | Osanai | 123/325 |
| 2005/0044938 | A1* | 3/2005 | Tsuruta et al. | 73/118.1 |
| 2005/0257607 | A1* | 11/2005 | Suzuki | 73/118.1 |
| 2005/0257608 | A1* | 11/2005 | Suzuki | 73/118.1 |
| 2005/0257780 | A1* | 11/2005 | Suzuki | 123/519 |
| 2006/0059979 | A1* | 3/2006 | Matsubara et al. | 73/118.1 |
| 2006/0185653 | A1* | 8/2006 | Everingham et al. | 123/520 |
| 2006/0225709 | A1* | 10/2006 | Washeleski et al. | 123/478 |
| 2007/0186915 | A1* | 8/2007 | Annoura | 123/698 |
| 2007/0246025 | A1* | 10/2007 | Sato et al. | 123/520 |
| 2008/0092858 | A1* | 4/2008 | Satoh et al. | 123/520 |
| 2011/0079201 | A1* | 4/2011 | Peters et al. | 123/520 |
| 2011/0197862 | A1* | 8/2011 | Der Manuelian et al. | 123/521 |
| 2011/0315127 | A1* | 12/2011 | Jackson et al. | 123/521 |

* cited by examiner

EVAPORATIVE EMISSION CONTROL DEVICE FOR AN INTERNAL COMBUSTION ENGINE

BACKGROUND OF THE INVENTION

1. Field of the Invention

The present invention relates to an evaporative emission control device for an internal combustion engine, and more specifically, to a control for detecting leakage in an evaporative emission control device.

2. Description of the Related Art

In order to prevent the fuel evaporative gas evaporated in a fuel tank from being emitted into atmosphere, there has been provided an evaporative emission control device for an internal combustion engine, including a canister interposed in a purge passage connecting the fuel tank and an intake passage of an internal combustion engine; a canister shutoff valve that opens or closes the canister to lead or seal the inside of the canister into or against atmosphere; a fuel tank shutoff valve that connects or disconnects the fuel tank and the canister; and a purge control valve that opens or blocks the purge passage. During fueling, the evaporative emission control device opens the canister shutoff valve and the fuel tank shutoff valve and closes the purge control valve so that fuel evaporative gas runs towards the canister, and makes the canister absorb the fuel evaporative gas. During the operation of the internal combustion engine, the evaporative emission control device opens the canister shutoff valve and the purge control valve, and thus discharges the fuel evaporative gas absorbed by the canister into the intake passage of the internal combustion engine. This is how the device treats the fuel evaporative gas. Furthermore, the evaporative emission control device carries out leakage detection to prevent the gas from leaking outside the device.

When leakage is detected in a conventional vehicle that is moved only with the driving force of an internal combustion engine, the opening and closing of the canister shutoff valve, the fuel tank shutoff valve and the purge control valve are controlled during the operation of the internal combustion engine, and the inside of the purge passage and the fuel tank are brought under negative pressure by using the negative pressure created in the intake passage of the internal combustion engine. The leakage judgment is made on the basis of whether or not the negative pressure is maintained. In this manner, leakage is detected.

However, in a vehicle such as a plug-in hybrid vehicle that is equipped with a motor apart from the internal combustion engine and moved by using the driving force of the motor, the internal combustion engine is hardly operated to improve fuel consumption. For this reason, if the leakage detection of the evaporative emission control device is intended to be carried out during the operation of the internal combustion engine, there is less chance of the leakage detection, and this is not preferable.

To solve the foregoing issue, a technology has been developed, which provides a negative-pressure pump that depressurizes the inside of the evaporative emission control device, and detects leakage in the evaporative emission control device by controlling the actuation of the negative-pressure pump and the opening/closing of a canister shutoff valve, a fuel tank shutoff valve and a purge control valve when an ignition key is off (Japanese Patent No. 4107053).

In an evaporative fuel processor described in the above-mentioned publication, the negative-pressure pump is first actuated, and thus, leakage in a part (canister, for example) of the evaporative fuel processor is detected. Secondly, the entire evaporative fuel processor including the fuel tank is brought under negative pressure, thereby detecting leakage in the entire evaporative fuel processor including the fuel tank.

However, if the leakage detection is applied to the entire evaporative fuel processor including the fuel tank after the leakage detection in a part of the evaporative fuel processor is finished, it takes time to carry out the leakage detection. Considering that the negative-pressure pump is actuated during leakage detection, the prolongation of leakage detection is undesirable as it leads to the power consumption of the batteries installed in a vehicle.

SUMMARY OF THE INVENTION

The invention has been made to solve the foregoing problems. It is an object of the invention to provide an evaporative emission control device for an internal combustion engine, which is capable of reducing the time of leakage detection.

In order to achieve the above object, the invention provides an evaporative emission control device for an internal combustion engine, comprising a first communication passage that connects a fuel tank and a canister that absorbs fuel evaporative gas generated from the fuel tank; a second communication passage that connects the canister and an intake passage of an internal combustion engine; a connecting hole that is formed in the canister and connects the inside and the outside of the canister; a negative-pressure generating unit that generates negative pressure in the canister and the fuel tank through the connecting hole; a pressure detector that detects internal pressure of the fuel tank or the canister; a tank opening-and-closing unit that is interposed in the first communication passage and opens/closes the connection between the fuel tank and the canister; and a communication passage opening-and-closing unit that is interposed in the second communication passage and opens/closes the connection between the intake passage and the canister, wherein there is provided a leakage judging unit that judges whether there is leakage in the canister and the fuel tank on the basis of a detected value of the pressure detector; and the leakage judging unit carries out leakage judyment with respect to the canister and the fuel tank while the negative-pressure generating unit generates negative pressure in the fuel tank and the canister with the tank opening-and-closing unit in an open position and with the communication passage opening-and-closing unit in a closed position.

This enables the leakage judging unit to judge that neither the canister nor the fuel tank is leaking if no leakage is identified at the leakage judgment with respect to the canister and the fuel tank. The leakage judging unit is then allowed to omit the leakage judgment with respect to each of the canister and the fuel tank, and reduces the time of leakage detection.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE PREFERRED EMBODIMENTS

An embodiment of the invention will be described below with reference to the attached drawings.

Figure 1:
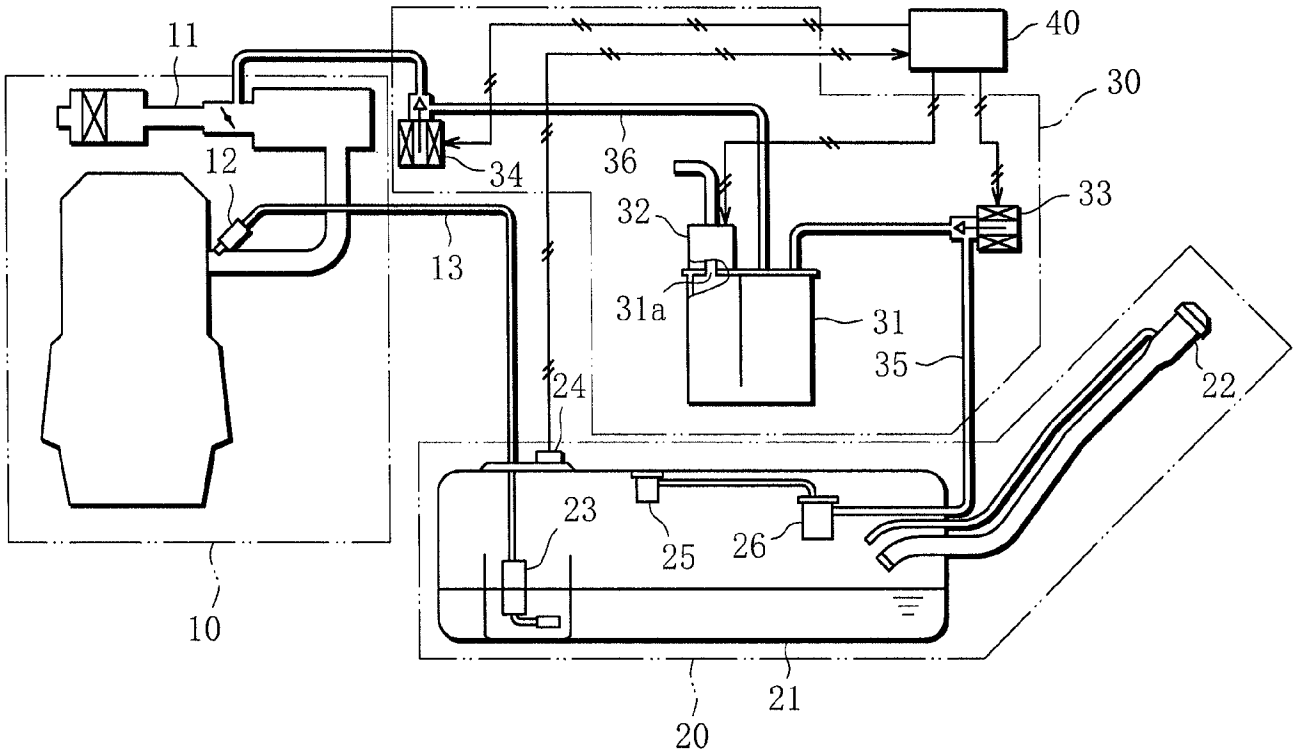
FIG. 1 is a schematic configuration view of an evaporative emission control device for an internal combustion engine according to the invention.
Figure 2A:
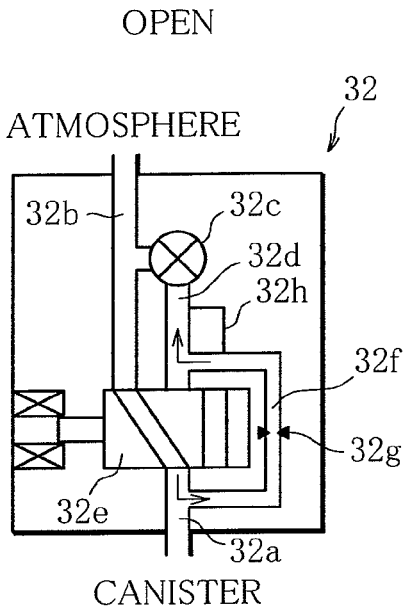
FIG. 2A shows an internal structure of an evaporative leakage checking module and an inactive state of a vent valve.
Figure 2B:
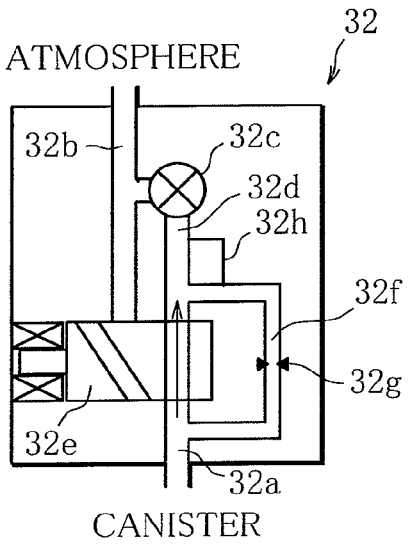
FIG. 2B shows the internal structure of the evaporative leakage checking module and an active state of the vent valve.

FIG. 1 is a schematic configuration view of an evaporative emission control device for an internal combustion engine according to the invention. FIG. 2A shows an internal structure of an evaporative leakage checking module and an inactive state of a vent valve. FIG. 2B shows the internal structure of the evaporative leakage checking module and an active state of the vent valve. Arrows in FIGS. 2A and 2B show the directions of air flow. The configuration of the evaporative emission control device for an internal combustion engine will be described below.

The evaporative emission control device for an internal combustion engine according to the invention includes a motor for moving a vehicle and an engine (internal combustion engine), not shown. The device is used in a hybrid vehicle that is moved by using either one or both of the motor and the engine.

As shown in FIG. 1, the evaporative emission control device for an internal combustion engine according to the invention is formed roughly of an engine 10 installed in a vehicle, a fuel reservoir 20 for storing fuel, a fuel evaporative gas processor 30 that processes the fuel evaporative gas evaporated in the fuel reservoir 20, and an electrical control unit (hereinafter, referred to as ECU) that is a controller for implementing comprehensive control on the vehicle (leakage judging unit) 40.

The engine 10 is a four-stroke straight-four gasoline engine of an intake-passage-injection (Multi Point Injection, MPI) type. The engine 10 is provided with an intake passage 11 that takes air into a combustion chamber of the engine 10. Downstream of the intake passage 11 lies a fuel injection valve 12 that injects fuel into an intake port of the engine 10. The fuel injection valve 12 is connected with a fuel line 13 and is supplied with fuel from a fuel tank 21 for storing fuel.

The fuel reservoir 20 includes the fuel tank 21, a fueling inlet 22 serving as an inlet through which fuel is fed into the fuel tank 21, a fuel pump 23 that supplies fuel from the fuel tank 21 through the fuel line 13 to the fuel injection valve 12, a pressure sensor 24 that detects pressure in the fuel tank 21, a fuel cutoff valve 25 that prevents fuel from escaping from the fuel tank 21 into the fuel evaporative gas processor 30, and a leveling valve 26 that controls liquid level in the fuel tank 21 during fueling. The fuel evaporative gas generated in the fuel tank 21 is discharged from the fuel cutoff valve 25, passes the leveling valve 26, and enters the fuel evaporative gas processor 30.

The fuel evaporative gas processor 30 includes a canister 31, an evaporative leakage checking module 32, a fuel tank shutoff valve (tank opening-and-closing unit) 33, a purge control valve (communication passage opening-and-closing unit) 34, a vapor line (first communication passage) 35, and a purge line (second communication passage) 36.

The canister 31 contains activated carbon. The canister 31 is connected with the vapor line 35 and the purge line 36 so that the fuel evaporative gas generated in the fuel tank 21 or the fuel evaporative gas absorbed by the activated carbon may be circulated. The canister 31 is provided with an atmosphere hole (connecting hole) 31*a* for inhaling outside air when discharging the fuel evaporative gas absorbed by the activated carbon.

As shown in FIGS. 2A and 2B, the evaporative leakage checking module 32 has a canister-side passage 32*a* leading to the atmosphere hole 31*a* of the canister 31 and an atmosphere-side passage 32*b* leading to atmosphere. The atmosphere-side passage 32*b* also leads to a pump passage 32*d* provided with a negative-pressure pump (negative-pressure generating unit) 32*c*. The evaporative leakage checking module 32 has a vent valve 32*e* and a bypass passage 32*f*. The vent valve 32*e* has an electromagnetic solenoid and is activated by the electromagnetic solenoid. As shown in FIG. 2A, the vent valve 32*e* connects the canister-side passage 32*a* and the atmosphere-side passage 32*b* with the electromagnetic solenoid switched off. As shown in FIG. 2B, the vent valve 32*e* connects the canister-side passage 32*a* and the pump passage 32*d* when the electromagnetic solenoid is switched on by receiving an activation signal transmitted from outside. The bypass passage 32*f* is a passage that constantly connects the canister-side passage 32*a* and the pump passage 32*d*. The bypass passage 32*f* is provided with a reference orifice 32*g* with a small diameter (0.5 mm, for example). Disposed between the negative-pressure pump 32*c* of the pump passage 32*d* and the reference orifice 32*g* of the bypass passage 32*f* is a pressure sensor (pressure detector) 32*h* that detects pressure in the bypass passage 32*f* located downstream of the pump passage 32*d* or the reference orifice 32*g*.

The fuel tank shutoff valve 33 is located in the vapor line 35 to be interposed between a fuel tank 21 and the canister 31. The fuel tank shutoff valve 33 has an electromagnetic solenoid and is activated by the electromagnetic solenoid. The fuel tank shutoff valve 33 is a normally-closed electromagnetic valve that is in a closed position when the electromagnetic solenoid is switched off, and comes into an open position when the electromagnetic solenoid is switched on by receiving an activation signal transmitted from outside. The fuel tank shutoff valve 33 blocks the vapor line 35 when in the closed position with the electromagnetic solenoid switched off. The fuel tank shutoff valve 33 opens the vapor line 35 when the electromagnetic solenoid is switched on by receiving the activation signal transmitted from outside. In other words, when in the closed position, the fuel tank shutoff valve 33 airtightly closes the fuel tank 21, and thus inhibits the fuel evaporative gas generated in the fuel tank 21 from flowing into the canister 31. When in the open position, the fuel tank shutoff valve 33 allows the fuel evaporative gas to flow into the canister 31.

The purge control valve 34 is interposed in the purge line 36 to be located between the intake passage 11 and the canister 31. The purge control valve 34 has an electromagnetic solenoid and is activated by the electromagnetic solenoid. The purge control valve 34 is a normally-closed electromagnetic valve that is in a closed position when the electromagnetic solenoid is switched off, and comes into an open position when the electromagnetic solenoid is switched on by receiving an activation signal transmitted from outside. The purge control valve 34 blocks the purge line 36 when in the closed position with the electromagnetic solenoid switched off. The purge control valve 34 opens the purge line 36 when in an open position with the electromagnetic solenoid switched on by receiving the activation signal from outside. In other words, when in the closed position, the purge control valve 34 inhibits the fuel evaporative gas from flowing from the canister 31 into the engine 10. When in the open position, the purge control valve 34 allows the fuel evaporative gas to flow from the canister 31 into the engine 10.

An ECU 40 is a controller for implementing the comprehensive control of a vehicle and includes an input/output device, a storage device (ROM, RAM, non-volatile RAM, etc.), a central processing unit (CPU), a timer, etc.

The pressure sensor 24 and a pressure sensor 32*h* are connected to an input side of the ECU 40. Information detected by these sensors is inputted into the ECU 40.

Connected to an output side of the ECU 40 are the fuel injection valve 12, the fuel pump 23, the negative-pressure pump 32*c*, the vent valve 32*e*, the fuel tank shutoff valve 33 and the purge control valve 34.

Based upon the detected information of the various sensors, the ECU 40 controls the opening/closing of the negative-pressure pump 32*c*, the vent valve 32*e*, the fuel tank shutoff valve 33 and the purge control valve 34. In this way, the ECU 40 makes a judgment as to whether leakage is occurring in the fuel reservoir 20 and the fuel evaporative gas processor 30, thereby detecting leakage.

[First Embodiment]

The following description explains the control of leakage judgment in the ECU 40 with respect of the fuel tank 21 and the canister 31 according to a first embodiment of the invention configured in the above-described manner.

Figure 3:
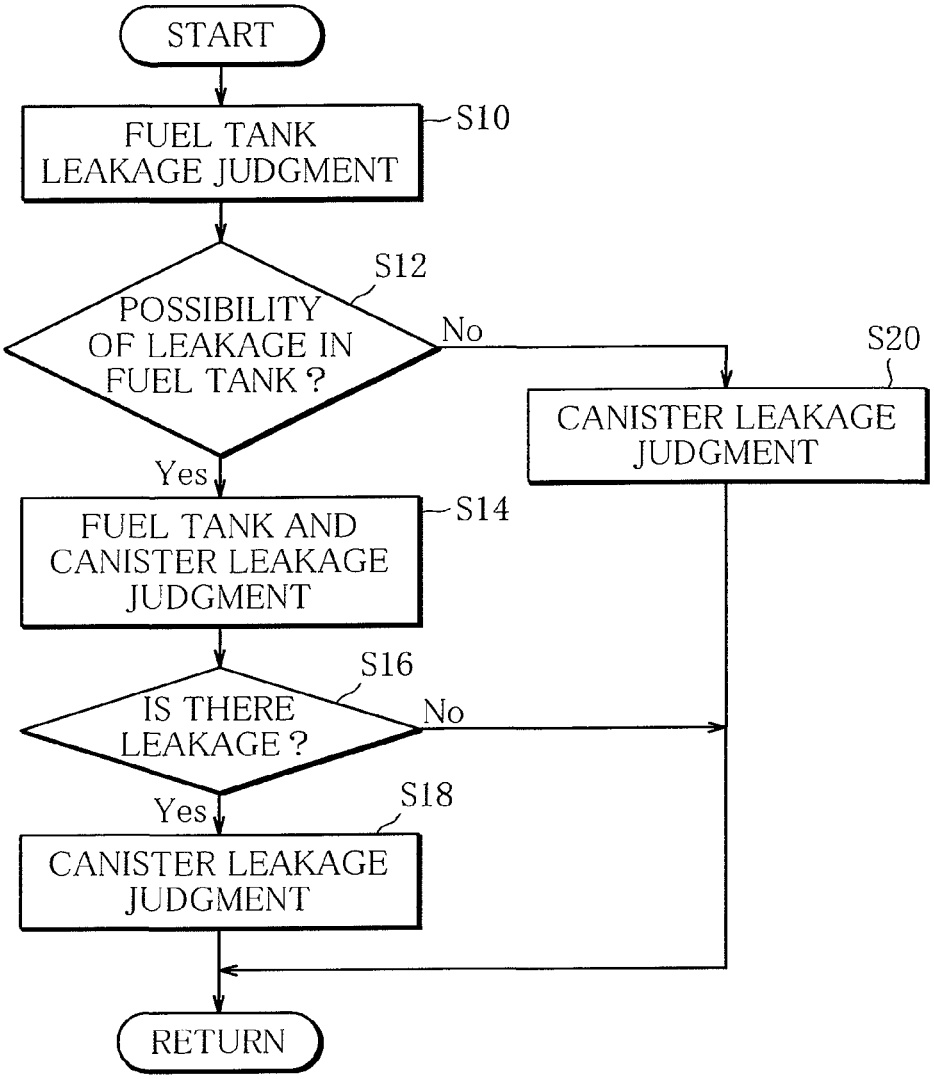
FIG. 3 is a flowchart showing leakage judyment control carried out by an ECU according to a first embodiment of the invention.
Figure 4:
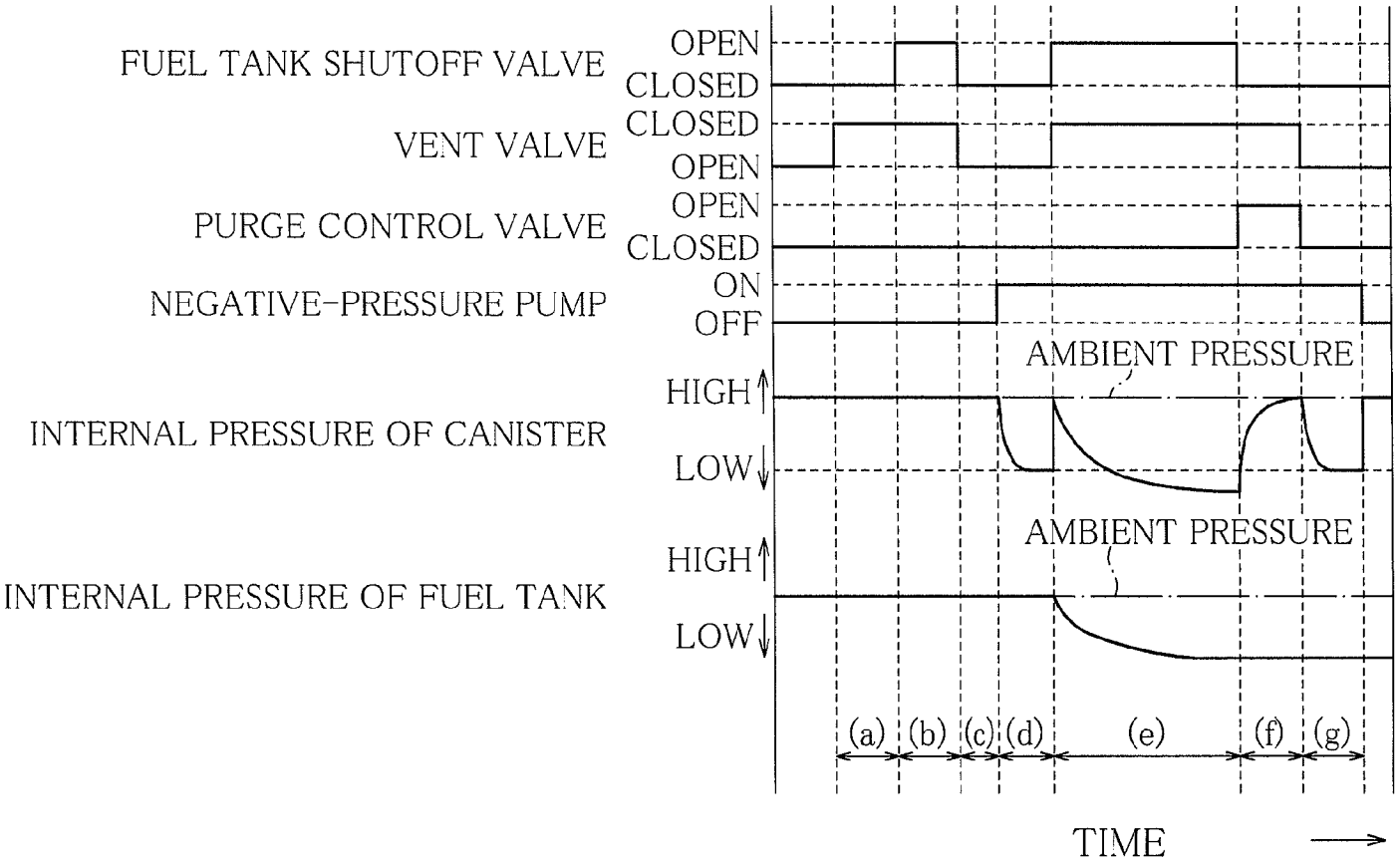
FIG. 4 is a time-sequence diagram showing an example of actuation of a fuel tank shutoff valve, the vent valve, a purge control valve and a negative-pressure pump, and an example of transition of internal pressures of a canister and a fuel tank according to the first embodiment of the invention.
Figure 5:
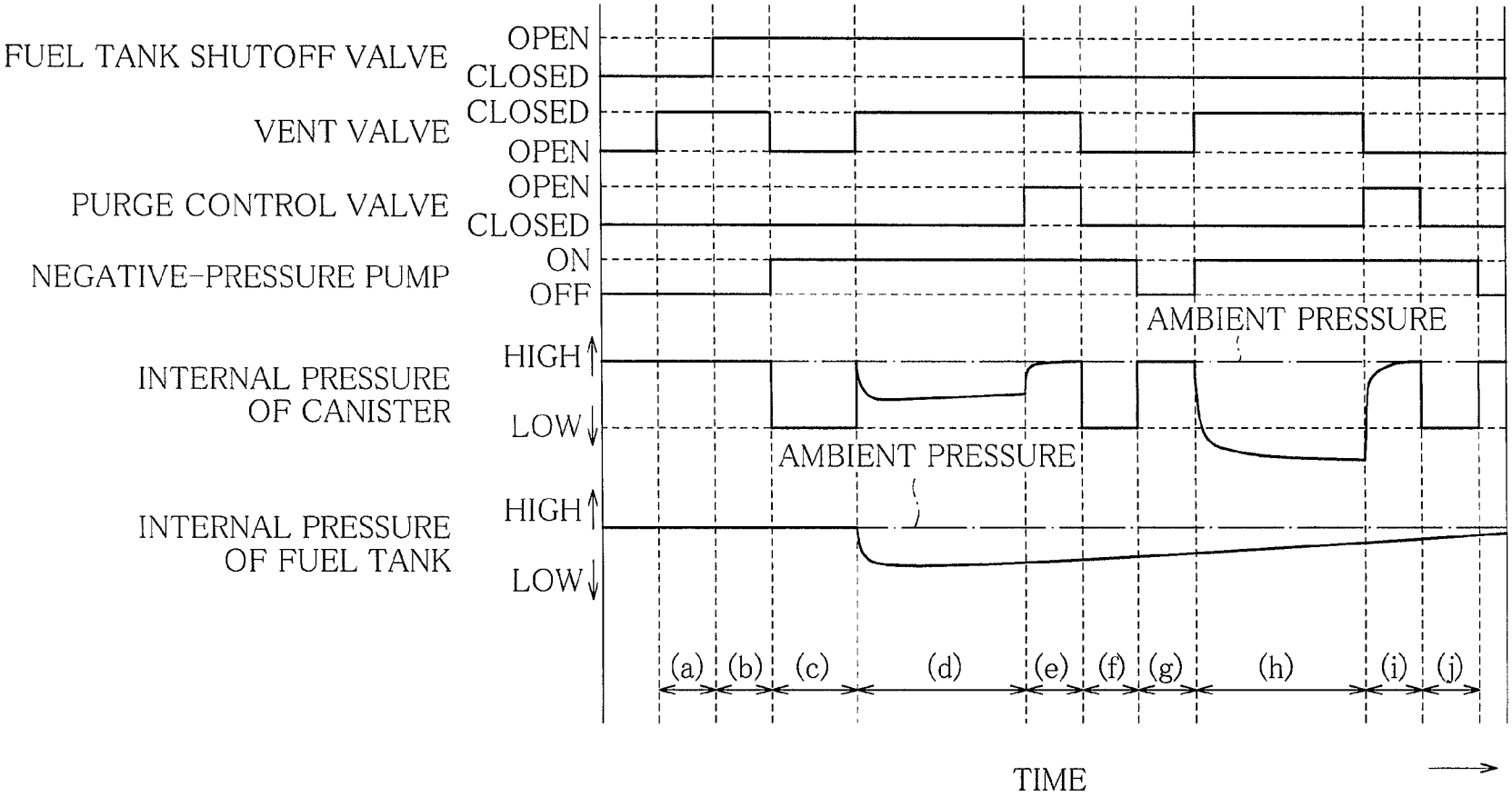
FIG. 5 is a time-sequence diagram showing an example of actuation of the fuel tank shutoff valve, the vent valve, the purge control valve and the negative-pressure pump, and an example of transition of internal pressures of the canister and the fuel tank according to the first embodiment of the invention.
Figure 6:
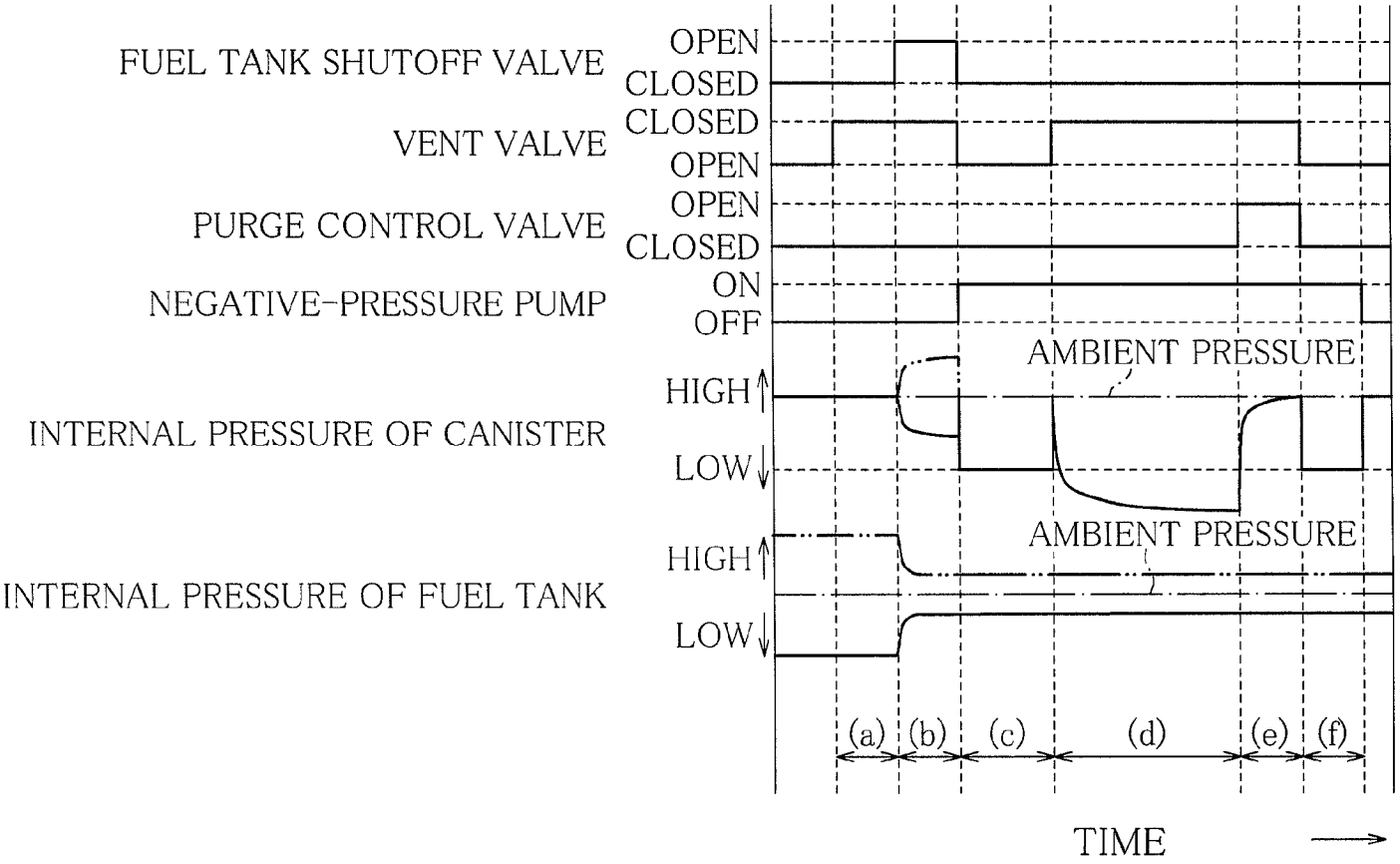
FIG. 6 is a time-sequence diagram showing an example of actuation of the fuel tank shutoff valve, the vent valve, the purge control valve and the negative-pressure pump, and an example of transition of internal pressures of the canister and the fuel tank according to the first embodiment of the invention.
Figure 7:
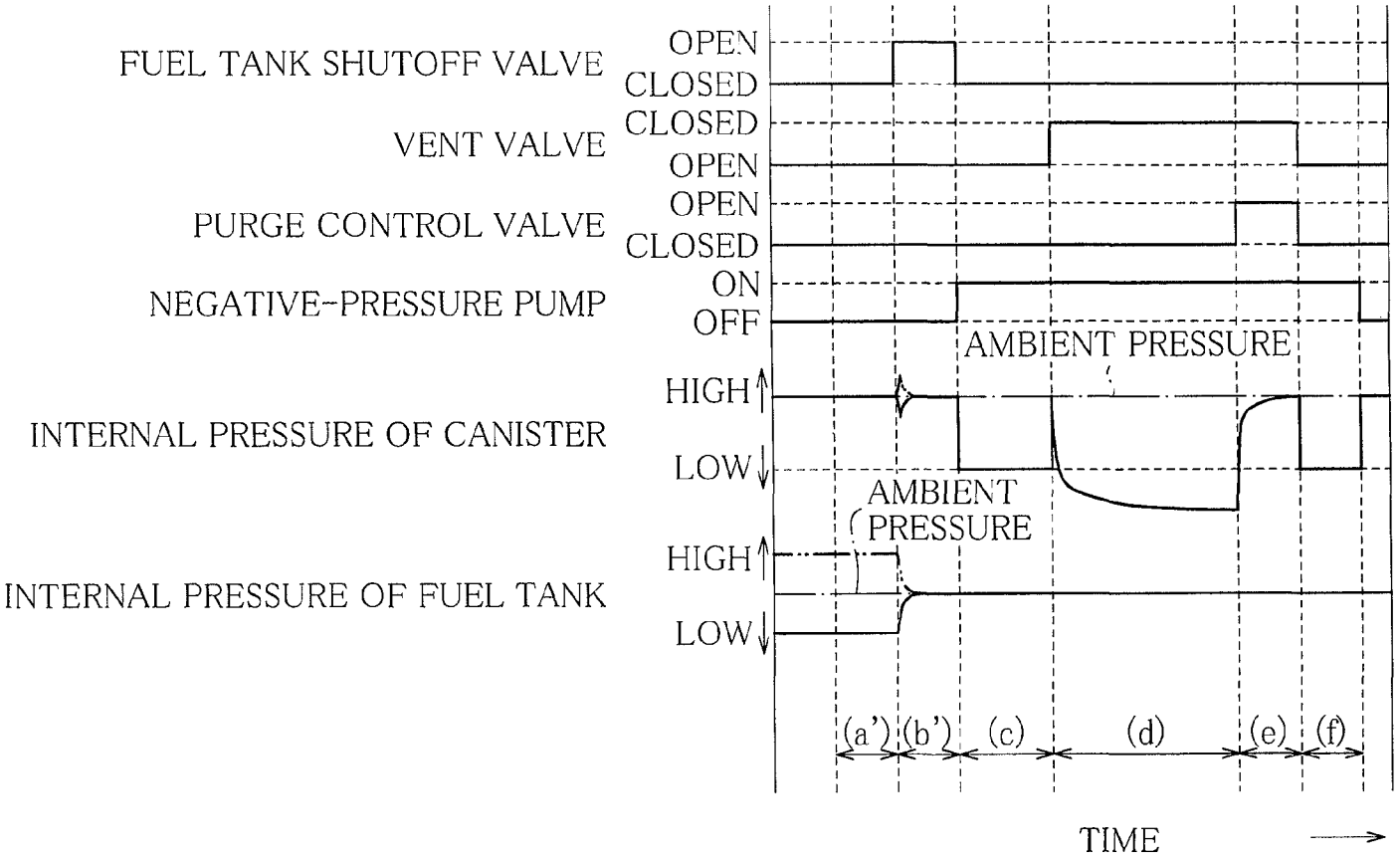
FIG. 7 is a time-sequence diagram showing an example of actuation of the fuel tank shutoff valve, the vent valve, the purge control valve and the negative-pressure pump, and an example of transition of internal pressures of the canister and the fuel tank according to a second embodiment of the invention.

FIG. 3 is a flowchart of the leakage judgment control implemented by the ECU 40. FIGS. 4, 5 and 6 are time-sequence diagrams showing examples of the actuation of the fuel tank shutoff valve 33, the vent valve 32*e*, the purge control valve 34 and the negative-pressure pump 32*c* and examples of transition of internal pressures of the canister 31 and the fuel tank 21. Chain double-dashed lines in FIGS. 6 and 7 represent a case where the internal pressure of the fuel tank 21 is positive, and dashed lines represent ambient pressure. Dashed lies in FIGS. 4, 5, 6 and 7 represent ambient pressures. FIG. 4 shows a case where it is provisionally judged at the initial judgment of leakage in the fuel tank 21 that there is a possibility of leakage in the fuel tank 21; the leakage judgment is carried out with respect to the fuel tank 21 and the canister 31; and it is found that neither the fuel tank 21 nor the canister 31 is leaking. FIG. 5 shows a case where it is provisionally judged at the initial judgment of leakage in the fuel tank 21 that there is a possibility of leakage in the fuel tank 21; the leakage judgment is carried out with respect to the fuel tank 21 and the canister 31; and it is found that there is no leakage in the canister 31, which means that the fuel tank 21 is leaking. FIG. 6 shows a case where it is judged at the initial judgment of leakage in the fuel tank 21 that there is no leakage in the fuel tank 21, and the leakage judgment is carried out with respect to the canister 31.

As shown in FIG. 3, Step S10 carries out the leakage judyment with respect to the fuel tank 21. More specifically, as shown in time periods (a) of FIGS. 4, 5 and 6, the electromagnetic solenoid of the vent valve 32*e* is switched on by receiving the activation signal transmitted from outside, to thereby connect the canister-side passage 32*a* and the pump-side passage 32*d* as shown in FIG. 2B. In the second place, as shown in time periods (b) of FIGS. 4, 5 and 6, the electromagnetic solenoid of the fuel tank shutoff valve 33 is switched on by receiving an activation signal transmitted from outside and thus opens the fuel tank shutoff valve 33. This way, the fuel tank 21 is opened into the canister 31. At this point of time, if the fuel tank 21 is not leaking, and the internal pressure of the fuel tank 21 is maintained positive or negative before the opening of the fuel tank shutoff valve 33, the internal pressure of the canister is changed to positive or negative as shown in the time period (b) of FIG. 6 in response to the opening of the fuel tank shutoff valve 33. If the fuel tank 21 is leaking or if the internal pressure of the fuel tank 21 is ambient pressure in the course of nature without leakage in the fuel tank 21, the internal pressures of the canister 31 and the fuel tank 21 are not changed as shown in the time period (b) of FIGS. 4 and 5. On the basis of these matters, it is judged that the fuel tank 21 is not leaking if there is a change in the internal pressures of the canister 31 and the fuel tank 21 as shown in the time period (b) of FIG. 6. If the internal pressures of the canister 31 and the fuel tank 21 are not changed as shown in the time period (b) of FIGS. 4 and 5, it is provisionally judged that there is a possibility of leakage in the fuel tank 21.

Step S12 makes a determination as to whether there is a possibility of leakage in the fuel tank 21. If the result is YES, and it has provisionally been judged in Step S10 that there is a possibility of leakage in the fuel tank 21, the routine proceeds to Step S14. If the result is NO, and it has been judged that the fuel tank 21 is not leaking, the routine moves to Step S20.

Step S14 carries out the leakage judgment with respect to the fuel tank 21 and the canister 31. To be specific, as shown in time periods (d) and (c) of FIGS. 4 and 5, respectively, the electromagnetic solenoid of the vent valve 32*e* is switched off by discontinuing the transmission of the activation signal to the electromagnetic solenoid. In this manner, the canister-side passage 32*a* and the atmosphere-side passage 32*b* are connected to each other as shown in FIG. 2A. Moreover, as shown in the time period (d) of FIG. 4, the electromagnetic solenoid of the fuel tank shutoff valve 33 is switched off to close the fuel tank shutoff valve 33 by discontinuing the transmission of the activation signal from outside to the electromagnetic solenoid. The vapor line 35 between the fuel tank 21 and the canister 31 is thus blocked, and the negative-pressure pump 32*c* is actuated. The purpose of this process is to generate negative pressure in the bypass passage 32*f* between the negative-pressure pump 32*c* and the reference orifice 32*g*. Therefore, it is also possible, as shown in a time period (c) of FIG. 5, to switch on the electromagnetic solenoid of the fuel tank shutoff valve 33 to open the fuel tank shutoff valve 33 by transmitting the activation signal from outside to the electromagnetic solenoid so that the fuel tank 21 opens into the canister 31. Pressure is detected by the pressure sensor 32h to be used as reference pressure (given value). As shown in time periods (e) and (d) of FIGS. 4 and 5, the vent valve 32*e* is actuated to connect the canister-side passage 32*a* and the pump passage 32*d*. At this time, the pressure sensor 32*h* is used to detect pressure. As shown in time periods (f) and (e) of FIGS. 4 and 5, respectively, the electromagnetic solenoid of the fuel tank shutoff valve 33 is switched off to close the fuel tank shutoff valve 33 by discontinuing the transmission of the activation signal to the electromagnetic solenoid. This way, the line between the fuel tank 21 and the canister 31 is blocked. The electromagnetic solenoid of the purge control valve 34 is switched on to open the purge control valve 34 by transmitting the activation signal from outside to the electromagnetic solenoid, to thereby connect the canister 31 and the intake passage 11. As shown in time periods (g) and (f) of FIGS. 4 and 5, respectively, the electromagnetic solenoid of the vent valve 32*e* is switched off by discontinuing the transmission of the activation signal to the electromagnetic solenoid, to thereby connect the canister-side passage 32*a* and the atmosphere-side passage 32*b* as shown in FIG. 2A. Furthermore, the electromagnetic solenoid of the purge control valve 34 is switched off to close the purge control valve 34 by discontinuing the transmission of the activation signal to the electromagnetic solenoid, to thereby block the purge line 36 between the canister 31 and the intake passage 11. At this time, pressure is detected by the pressure sensor 32*h* to be used again as reference pressure. As shown in FIG. 4, if the pressure detected in the time period (e) of FIG. 4 is lower than the reference pressure detected again in the time period (g) of FIG. 4, that is, if the negative pressure is higher than the reference pressure, it is judged that neither the fuel tank 21 nor the canister 31 is leaking. As shown in FIG. 5, if the pressure detected in a time period (d) of FIG. 5 is higher than the reference pressure detected again in a time period (f) of FIG. 5, that is, if the negative pressure is lower than the reference pressure, it is judged that there is a hole larger than the internal diameter of the reference orifice 32*g*. It is accordingly judged that either the fuel tank 21 or the canister 31 is leaking.

Step S16 makes a determination as to whether either the fuel tank 21 or the canister 31 is leaking. If the result is YES, and it has already been judged in Step S14 that either the fuel tank 21 or the canister 31 is leaking, the routine advances to Step S18. If the result is NO, and it has been judged that neither the fuel tank 21 nor the canister 31 is leaking, the routine ends.

Step S18 carries out the leakage judgment with respect to the canister 31. As shown in a time period (g) of FIG. 5, the electromagnetic solenoid of the fuel tank shutoff valve 33 is switched off to close the fuel tank shutoff valve 33 by discontinuing the transmission of the activation signal to the electromagnetic solenoid, to thereby block the line between the fuel tank 21 and the canister 31. The electromagnetic solenoid of the vent valve 32*e* is switched off by discontinuing the transmission of the activation signal to the electromagnetic solenoid, to thereby connect the canister-side passage 32*a* and the atmosphere-side passage 32*b* as shown in FIG. 2A. The electromagnetic solenoid of the purge control valve 34 is switched off to close the purge control valve 34 by discontinuing the transmission of the activation signal to the electromagnetic solenoid, to thereby block the line between the canister 31 and the intake passage 11. Furthermore, the negative-pressure pump 32*c* is stopped. As shown in a time period (h) of FIG. 5, the canister-side passage 32*a* and the pump passage 32*d* are connected to each other by actuating the vent valve 32*e*. The negative-pressure pump 32*c* is also actuated. At this time, the pressure sensor 32*h* is used to detect pressure. As shown in a time period (i) of FIG. 5, the electromagnetic solenoid of the vent valve 32*e* is switched off by discontinuing the transmission of the activation signal to the electromagnetic solenoid, to thereby connect the canister-side passage 32*a* and the atmosphere-side passage 32*b* as shown in FIG. 2A. The electromagnetic solenoid of the purge control valve 34 is switched on to open the purge control valve 34 by transmitting the activation signal from outside to the electromagnetic solenoid, to thereby connect the canister 31 and the intake passage 11. As shown in a time period (j) of FIG. 5, the electromagnetic solenoid of the purge control valve 37 is switched off to close the purge control valve 34 by discontinuing the transmission of the activation signal to the electromagnetic solenoid, to thereby block the line between the canister 31 and the intake passage 11. Pressure is detected by the pressure sensor 32*h* to be used again as reference pressure. As shown in FIG. 5, if the pressure detected in the time period (h) of FIG. 5 is lower than the reference pressure detected again in the time period (j) of FIG. 5, that is, if the negative pressure is higher than the reference pressure, it is judged that the canister 31 is not leaking. Since it has already been judged in Step S14 that either the fuel tank 21 or the canister 31 is leaking, it is judged that the fuel tank 21 is leaking. If the pressure detected by the pressure sensor 32*h* is higher than the reference pressure, that is, if the negative pressure is lower than the reference pressure, it is judged there is a hole larger than the internal diameter of the reference orifice 32*g*. It is therefore judged that the canister 31 is leaking. The routine then ends.

Step S20 carries out the leakage judgment with respect to the canister 31. To be specific, as shown in the time period (c) of FIG. 6, the electromagnetic solenoid of the vent valve 32*e* is switched off by discontinuing the transmission of the activation signal to the electromagnetic solenoid, to thereby connect the canister-side passage 32*a* and the atmosphere-side passage 32*b* as shown in FIG. 2A. At the same time, the electromagnetic solenoid of the fuel tank shutoff valve 33 is switched off to close the fuel tank shutoff valve 33 by discontinuing the transmission of the activation signal to the electromagnetic solenoid, to thereby block the line between the fuel tank 21 and the canister 31. The negative-pressure pump 32*c* is then actuated. Pressure is detected by the pressure sensor 32*h* to be used as reference pressure. As shown in the time period (d) of FIG. 6, the canister-side passage 32*a* and the pump passage 32*d* are connected to each other by actuating the vent valve 32*e*. At this time, the pressure sensor 32*h* is used to detect pressure. As shown in the time period (e) of FIG. 6, the electromagnetic solenoid of the purge control valve 34 is switched on to open the purge control valve 37 by transmitting the activation signal from outside to the electromagnetic solenoid, to thereby connect the canister 31 and the intake passage 11. As shown in the time period (f) of FIG. 6, the electromagnetic solenoid of the vent valve 32*e* is switched off by discontinuing the transmission of the activation signal to the electromagnetic solenoid, to thereby connect the canister-side passage 32*a* and the atmosphere-side passage 32*b* as shown in FIG. 2A. Moreover, the electromagnetic solenoid of the purge control valve 37 is switched off to close the purge control valve 37 by discontinuing the transmission of the activation signal to the electromagnetic solenoid, to thereby block the line between the canister 31 and the intake passage 11. Pressure is detected by the pressure sensor 32*h* to be used again as reference pressure. If the pressure detected in the time period (d) of FIG. 6 is lower than the reference pressure detected again in the time period (f) of FIG. 6, that is, if the negative pressure is higher than the reference pressure, it is judged that the canister 31 is not leaking. If the pressure detected by the pressure sensor 32*h* is higher than the reference pressure, that is, if the negative pressure is lower than the reference pressure, it is judged there is a hole larger than the internal diameter of the reference orifice 32*g*. It is accordingly judged that the canister 31 is leaking. The routine then ends.

As described above, in the evaporative emission control device for an internal combustion engine according to the first embodiment of the invention carries out the leakage judgment with respect to the fuel tank 21 and the canister 31 in and after the time period (d) of FIG. 4 if the internal pressure of the fuel tank 21 is ambient pressure as shown in FIG. 4, and it is unclear whether the fuel tank 21 is leaking at the initial judgment of leakage in the fuel tank 21. If the internal pressure of the canister is lower than the reference pressure as shown in the period (e) of FIG. 4, that is, if the negative pressure is higher than the reference pressure, it is judged that neither the fuel tank 21 nor the canister 31 is leaking. If the internal pressure of the canister is higher than the reference pressure as shown in the period (d) of FIG. 5, that is, if the negative pressure is lower than the reference pressure, it is judged that either the fuel tank 21 or the canister 31 is leaking. Thereafter, the leakage judyment with respect to the canister 31 alone, which is carried out in and after the period (g) of FIG. 5, is started. If the internal pressure of the canister is lower than the reference pressure as shown in the period (h) of FIG. 5, that is, if the negative pressure is higher than the reference pressure, it is judged that there is no leakage in the canister 31 and that the fuel tank 21 is leaking.

If the leakage judgment with respect to the fuel tank 21 and the canister 31 judges that neither the fuel tank 21 nor the canister 31 is leaking, the leakage judgment with respect to the canister 31 alone is omitted. The time of leakage detection can be reduced this way. This consequently reduces the actuation time of the negative-pressure pump 32*c* in the leakage judgment, and the power consumption of the batteries installed in a vehicle can be also decreased.

Since the leakage judgment is carried out on the basis of the reference pressure, it is possible to make a determination without fail as to whether or not there is leakage.

Furthermore, the reference pressure of the leakage judgment is set on the basis of the pressure generated in the reference orifice 32*g*, so that the reference pressure is not changed even if there is a change in ambient pressure. It is therefore possible to carry out the leakage judyment with accuracy.

[Second Embodiment]

The evaporative emission control device for an internal combustion engine according to the second embodiment of the invention will be described below.

The second embodiment differs from the first embodiment in that the vent valve 32*e* is opened in the method of judging leakage in the fuel tank 21 in Step S10 of the flowchart of leakage judyment control that is implemented by the ECU 40 in FIG. 3. The following description is about the leakage judgment with respect to the fuel tank 21 in the ECU 40.

FIG. 7 is a time-sequence diagram showing an example of actuation of the fuel tank shutoff valve 33, the vent valve 32*e*, the purge control valve 34 and the negative-pressure pump 32*c*, and an example of transition of internal pressures of the canister 31 and the fuel tank 21. In FIG. 7, the chain double-dashed line represents a case where the pressure in the fuel tank 21 is positive, and a dashed line represents ambient pressure.

As shown in FIG. 3, Step S10 carries out the leakage judgment with respect to the fuel tank 21. More specifically, as shown in a time period (a') FIG. 7, the vent valve 32*e*, the fuel tank shutoff valve 33, the purge control valve 37 and the negative-pressure pump 32*c* are not actuated. The electromagnetic solenoid of the fuel tank shutoff valve 33 is switched on to open the fuel tank shutoff valve 33 by transmitting the activation signal from outside to the electromagnetic solenoid as shown in (b') of FIG. 7, to thereby open the fuel tank 21 into the canister 31. In short, the inside of the fuel tank 21 is opened into atmosphere. At this time, if the fuel tank 21 is not leaking, and the internal pressure of the fuel tank 21 is maintained positive or negative before the opening of the fuel tank shutoff valve 33, the internal pressure of the fuel tank 21 is changed to ambient pressure as in the time period (b') of FIG. 7 in response to the opening of the fuel tank shutoff valve 33. If the fuel tank 21 is leaking or if the internal pressure of the fuel tank 21 is ambient pressure in the course of nature without leakage in the fuel tank 21, the internal pressure of the fuel tank 21 is not changed as in the first embodiment. On the basis of these matters, it is judged that the fuel tank 21 is not leaking if there is a change in the internal pressure of the fuel tank 21. If the internal pressure of the fuel tank 21 is not changed, it is provisionally judged that there is a possibility of leakage in the fuel tank 21.

As described above, in the evaporative emission control device for an internal combustion engine according to the second embodiment of the invention actuates the tank opening-and-closing unit 33 at an early stage of the leakage judgment, and thus carries out the leakage judgment with respect to the fuel tank 21 on the basis of a change in the internal pressure of the fuel tank 21. For that reason, the second embodiment includes one step less than the first embodiment since it is not required to actuate the vent valve 32*e*. This further reduces the time of leakage detection.

This is the end of the description of the embodiments of the invention, but the invention is not limited to the above-mentioned embodiments.

The foregoing embodiments carry out the leakage judgment with respect to the canister 31 or with respect to the fuel tank 21 and the canister 31 after the leakage judgment of the fuel tank 21. However, it is also possible to carry out the leakage judgment of the fuel tank 21 and the canister 31 at the beginning.

According to the foregoing embodiments, the pressure sensor 32*h* is used to detect the pressure generated in the reference orifice 32*g*. Instead of this, it is also possible, for example, to previously make the ECU 40 memorize a given value and carry out the leakage judgment by comparing a detected value with the given value.

What is claimed is:

1. An evaporative emission control device for an internal combustion engine comprising:

a first communication passage that connects a fuel tank and a canister that absorbs fuel evaporative gas generated from the fuel tank; a second communication passage that connects the canister and an intake passage of an internal combustion engine; a connecting hole that is formed in the canister and connects the inside and the outside of the canister; a negative-pressure generating unit that generates negative pressure in the canister and the fuel tank through the connecting hole; a pressure detector that detects internal pressure of the canister; a tank opening-and-closing unit that is interposed in the first communication passage and opens/closes the connection between the fuel tank and the canister; and a communication passage opening-and-closing unit that is interposed in the second communication passage and opens/closes the connection between the intake passage and the canister, wherein there is provided a leakage judging unit that judges whether there is leakage in the canister and the fuel tank on the basis of a detected value of the pressure detector;

the leakage judging unit carries out leakage judgment with respect to the canister and the fuel tank while negative pressure is generated by the negative-pressure generating unit in the fuel tank and the canister with the tank opening-and-closing unit in an open position and with the communication passage opening-and-closing unit in a closed position, and the leakage judging unit carries out leakage judgment with respect to the canister with the communication passage opening-and-closing unit in the closed position, after the tank opening-and-closing unit is changed from the open position to a closed position and the canister is connected to the intake passage with the communication passage opening-and-closing unit in an open position, after it is judged at the leakage judgment with respect to the canister and the fuel tank that there is leakage.

2. The evaporative emission control device for an internal combustion engine according to claim 1, wherein the leakage judging unit carries out the leakage judgment with respect to the canister and the fuel tank and judges that there is leakage when the detected value of the pressure detector does not decrease to a given value.

* * * * *